United States Patent [19]

Maurer

[11] 4,323,184

[45] Apr. 6, 1982

[54] APPARATUS FOR FILLING THE MAGAZINE OF A FASTENER DRIVER

[75] Inventor: Werner Maurer, Nuertingen-Zizishausen, Fed. Rep. of Germany

[73] Assignee: Firma Karl M. Reich Maschinenfabrik GmbH, Nuertingen, Fed. Rep. of Germany

[21] Appl. No.: 140,431

[22] Filed: Apr. 15, 1980

[30] Foreign Application Priority Data

Apr. 25, 1979 [DE] Fed. Rep. of Germany ..... 2916633

[51] Int. Cl.[3] ..... B25C 5/06

[52] U.S. Cl. ..... 227/120; 141/362; 193/40; 206/338; 227/126

[58] Field of Search ..... 227/120, 125, 126, 139, 227/156; 206/338; 221/290, 296; 193/32, 35 A, 40; 81/57.37, 430–435; 141/351, 360, 362

[56] References Cited

U.S. PATENT DOCUMENTS

| | | | |
|---|---|---|---|
| 2,999,241 | 9/1961 | Starr | 227/126 |
| 3,086,207 | 4/1963 | Lingle et al. | 227/130 |
| 3,235,125 | 2/1966 | Sonntag | 221/290 X |
| 3,612,383 | 10/1971 | Perkins et al. | 227/125 |
| 3,797,723 | 3/1974 | Perkins et al. | 227/126 X |
| 4,197,974 | 4/1980 | Morton et al. | 227/130 X |

*Primary Examiner*—Howard N. Goldberg
*Assistant Examiner*—Fred A. Silverberg
*Attorney, Agent, or Firm*—W. G. Fasse; D. F. Gould

[57] ABSTRACT

Nails, screws and the like, referred to as fasteners, are automatically supplied into the magazine of a driver for the fasteners from a supply chute. A slide pusher may extend out of the free end of the magazine and cooperates with a gate at the discharge end of the supply chute, whereby the gate is opened when the free end of the magazine is inserted into the discharge end of the supply chute. In this position the magazine slide pusher is located in a recess to permit the fasteners to freely pass by the slide pusher into the magazine guide channel. When the magazine is full it is withdrawn from the supply chute, whereby a spring closes the gate and the slide pusher is moved back into the magazine guide channel to push the fasteners toward the magazine discharge end under the force of a spring in the magazine.

5 Claims, 4 Drawing Figures

APPARATUS FOR FILLING THE MAGAZINE OF A FASTENER DRIVER

BACKGROUND OF THE INVENTION

The invention relates to an apparatus for filling the magazine of a fastener drive, preferably directly from a sorting apparatus capable of feeding the fasteners directly into the magazine. The sorting apparatus includes a transfer mechanism for feeding the fasteners into the magazine of a driver such as an automatic driver for nails, screws and the like. The transfer mechanism normally includes a supply chute with inclined guide rails. The fastener discharge end of the chute is normally provided with a gate mechanism to prevent fasteners from falling out of the chute.

Sorting machines of this type are used for sorting nails, screws, pins, and the like, herein called collectively "fasteners". After the sorting these fasteners are made available in a supply chute in which they are arranged in parallel to one another and in a row or column. In a known sorting apparatus the supply chute is defined by two inclined guide rails in which, for example, nails are suspended by their heads to hang downwardly under the effect of gravity and to slide downwardly in the supply chute also under the effect of gravity until the first fastener or nail is held back at the discharge end of the supply chute by the gate mechanism arranged at said discharge end.

The nails loosely held in the supply chute are to be filled into a magazine, preferably automatically, which magazine is operatively connected to an automatic driver such as a nail driver or a screw driver mechanism. For this purpose the free end of the magazine is inserted between the guide rails of the supply chute to thereby open the gate mechanism and permit the nails to glide under the force of gravity into the magazine. Gravity also feeds the nails into the driver proper because the nails slide downwardly on the inclined side members of the driver magazine toward the driving ram.

Due to the gravity feed of the fasteners in the driver magazine, the driver may be used only in a predetermined position permitting the nails to slide downwardly toward the driver ram. This type of apparatus is not suitable for driving the fasteners in any direction or at any angle relative to the vertical. For driving devices of this type it is necessary to employ a spring biased slide pusher in the driver magazine. Such slide pushers are known as such. If the magazine is empty, the slide pusher is located immediately adjacent to the driving ram. The operator then must move the slide pusher back to the free end of the magazine where the slide pusher is arrested in a fixed position. However, if the operator inadvertently forgets pulling the slide pusher back into the arrested position it happens that fasteners are filled into the magazine while the slide pusher is still in its lowermost position in the magazine adjacent to the driving ram. Thus, fasteners are placed behind the slide pusher and the entire apparatus becomes inoperable until the fasteners are removed from the magazine, the slide pusher pulled back, and the fasteners filled back into the magazine.

OBJECTS OF THE INVENTION

In view of the above it is the aim of the invention to achieve the following objects singly or in combination:

to avoid the above difficulties, more specifically, to provide a fastener transfer mechanism for a driver apparatus with a magazine which can be filled only when the slide pusher in the magazine is located in its pulled-back transfer position;

to free the operator from performing unnecessary operations;

to make sure that the slide pusher itself in its pulled back position opens the gate at the discharge end of the supply chute; and to fill the magazine of a driver operable in any direction in the same manner as the magazine of a driver operable in the vertical direction downwardly.

SUMMARY OF THE INVENTION

According to the invention there is provided an apparatus for filling the magazine of a fastener driver in which the slide pusher in the driver magazine itself actuates the gate means at the discharge end of a supply chute, whereby it is assured that the magazine can only be filled with fasteners if the magazine slide pusher is in its pulled-back end position.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
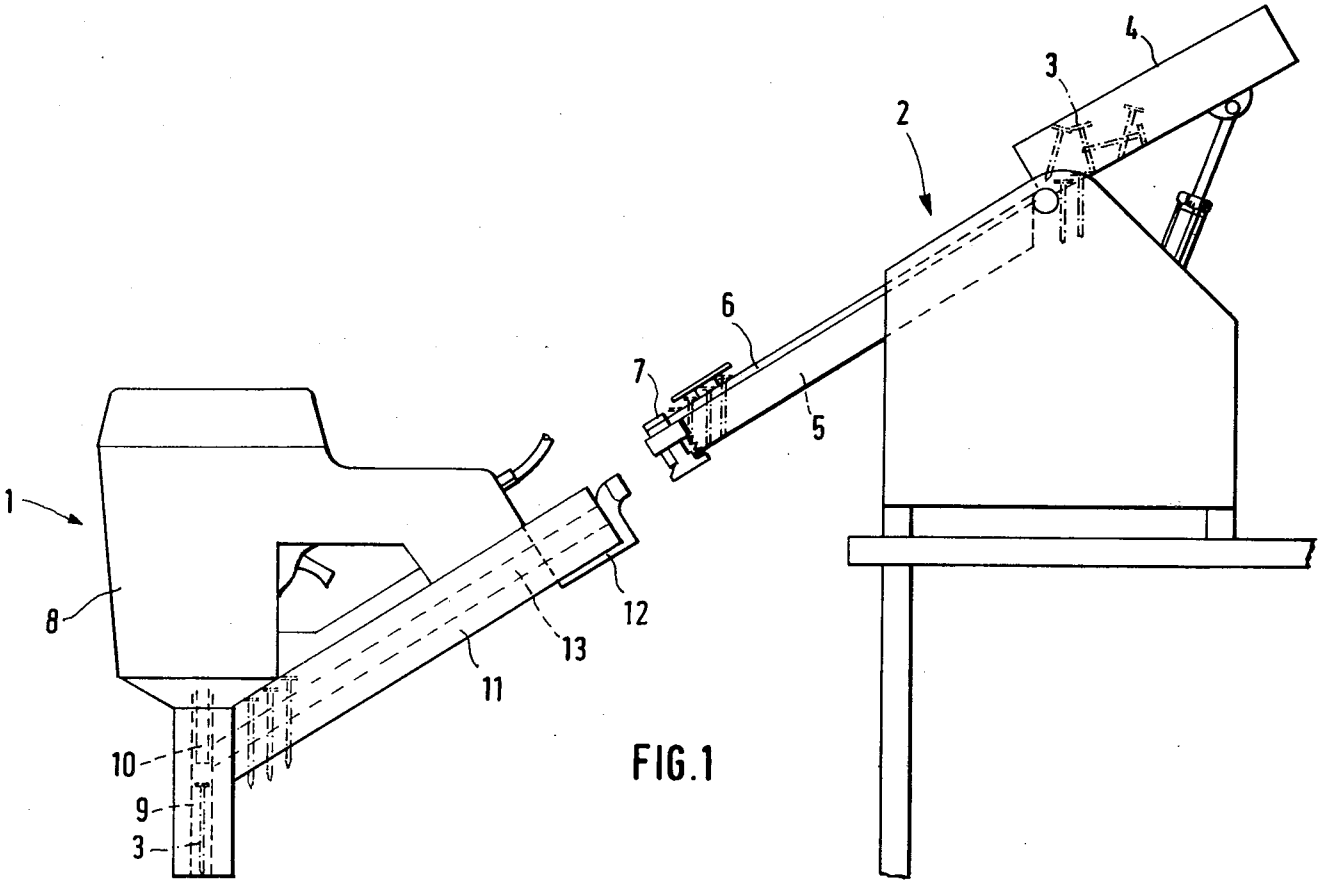
FIG. 1 shows a somewhat simplified side view of a driver with its magazine and a sorting apparatus with its discharge or supply chute.

FIG. 1 shows the system according to the invention with a driver 1 and a sorting apparatus 2 in which fasteners 3, such as nails, are sorted into an oscillating or vibrating rocker chute 4 which presents the nails 3 at its output to move, substantially by gravity, with the head facing upwardly into the discharge chute 5 of the sorting apparatus 2. The discharge chute 5 comprises two parallel, downwardly sloping guide rails 6. Such devices are known in the art. Instead of the vibrating rocker chute 4 an electromagnetically operating vibrating container may be employed to which the guide rail 6 forming the supply or discharge chute 5 are connected. Such electromagnetically operated vibrating containers are also known in the art.

The lower free discharge end of the chute 5 is equipped with a gate mechanism 7 which makes sure that the fasteners 3 cannot fall out of the supply chute 5 as long as the gate mechanism is closed.

The driver 1 which is also known, comprises a housing 8 and a discharge channel 9 in which a driving ram 10 is movable up and down, for example, driven by an air pressure operated driving mechanism.

A magazine 11 is secured to the driver 1 and holds a supply of fasteners 3 which are moved into the discharge channel 9 by a magazine slide pusher 12 under the force of a spring 13, kfor example, in the form of a so-called roller spring with relatively flat helical turns.

Figure 2:
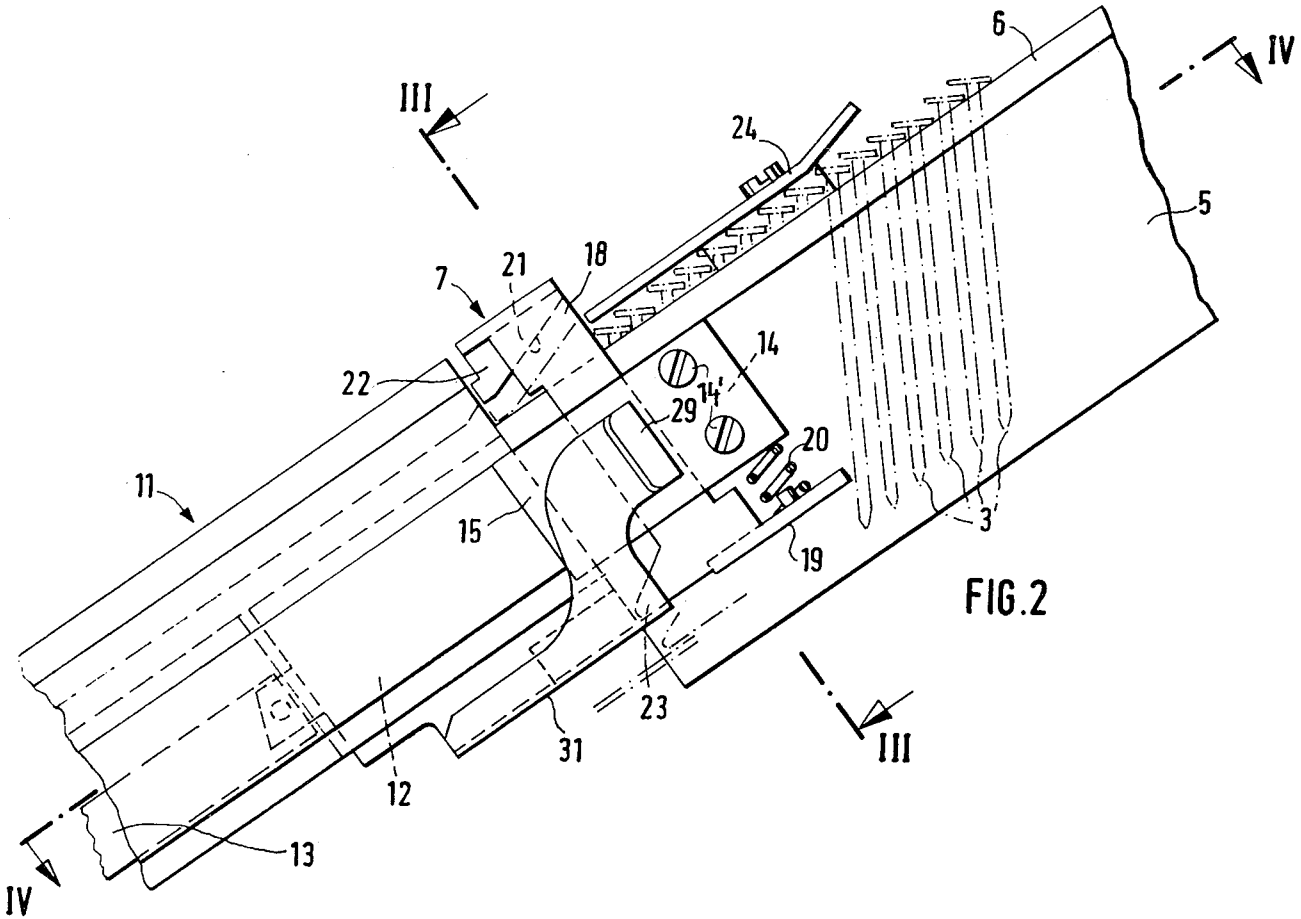
FIG. 2 shows a side view of the transfer mechanism between the driver magazine and the supply chute of the sorting apparatus in the fastener transferring position.
Figure 4:
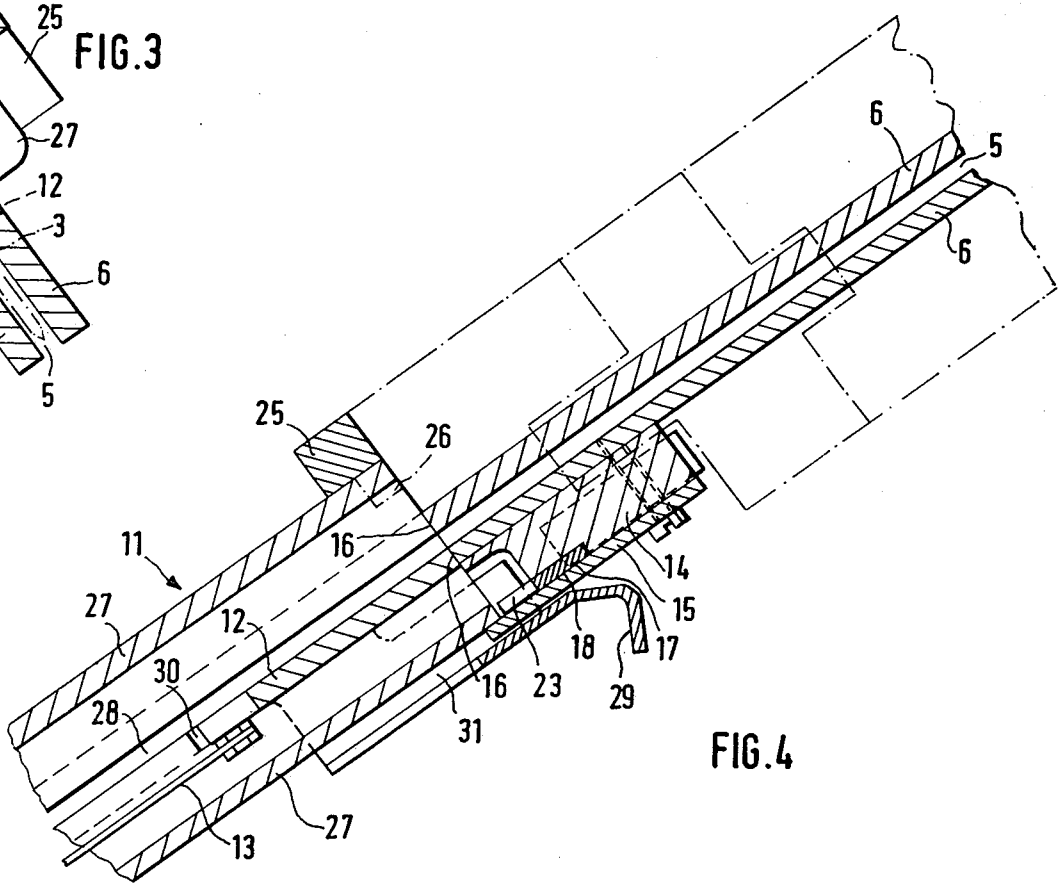
FIG. 4 is a sectional view along section line 4—4 in FIG. 2, whereby the fasteners are not shown in FIG. 4 for simplicity's sake.
Figure 3:
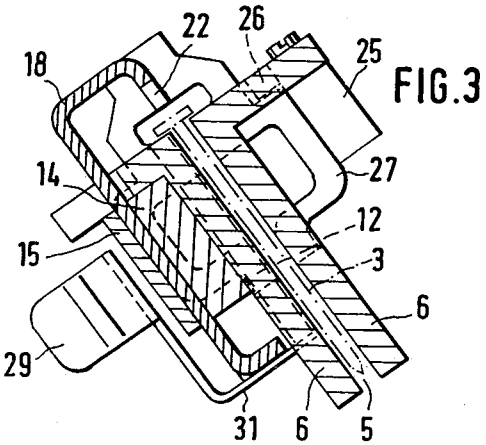
FIG. 3 illustrates a sectional view along section line 3—3 in FIG. 2.

FIGS. 2, 3, and 4 show the details of the transfer mechanism according to the invention between the magazine 11 and the supply chute 5, 6, whereby in FIG. 2 the chute 5, 6 and the magazine 11 are shown in the transferring position. A support block 14 is secured to one of the guide rails 6 at the discharge end of the chute 5. The block 14 and a cover plate 15 are held in position, for example by screws 14'. The cover plate extends beyond the forward facing surface 16 of the guide rail 6.

A guide slot 17 is located between the support block 14 and the cover plate 15. A slide gate 18 is operatively supported in the slot 17 for displacement perpendicularly relative to the guide rail 6. A pressure spring 20 is operatively arranged between the support block 14 and an extension 19 (FIG. 2) of the slide gate 18. The pressure spring 20 presses the slide gate 18 downwardly in such a manner that a gate plate or member 22 which is provided with a slanted gate surface 21 limits the supply chute 5 at the upper side thereof in such a manner that the fasteners 3 are prevented from falling out of the supply chute 5 when the gate 18 is in its down position. The slanted surface 21 is shown in dashed lines and the fasteners are shown by dash-dotted lines in FIG. 2. The slide gate 18 comprises at its lower end a contact member 23 for cooperation with contact plate 31.

The supply chute 5 is covered at its top by a stop plate 24 located near the forward or free end of one of the guide rails 6. A further guide member 25 having a contact cam 26 is secured to the forward facing surface 16 of the rail 6 which also carries the stop plate 24. The guide member 25 protrudes beyond the forward facing surface 16 of the guide rail 6.

The conventional magazine 11 comprises two side members 27 forming a guide chute 28 which receives the fasteners 3 to supply them to the discharge channel 9 of the driver 1 under the force of the spring 13 acting on the slide pusher 12.

The magazine slide pusher 12 is slidably supported in the guide chute or channel 28. The slide pusher 12 is operatively connected to a so-called roller spring 13 and may be cocked into a recess 30 in the side wall 27 as best seen in FIG. 4. Such cocking is facilitated by a bail 29 by means of which the operator may pull back the slide pusher 12 along the chute 28 until it may be pulled sideways into the recess 30, whereby the guide chute 28 aligns directly with the supply chute 5 also as best seen in FIG. 4. After pulling the pusher 12 laterally outwardly into the recess 30, the pusher 12 will be retained in the recess 30 until it is again moved into the guide chute or channel 28. As long as the pusher 12 is retained in the recess 30, the chute 28 is open rearwardly. The bail 29 is operatively connected to the magazine slide pusher 12 by means of a contact or connector plate 31.

In order to fill the magazine, the slide pusher 12 is first brought into the position in the recess 30 as shown in FIG. 4. Thereafter, the rear end of the magazine is held against the facing surface 16 of the guide rails 6 of the supply discharge chute 5 as shown in FIG. 2, whereby the contact plate 31 of the slide pusher 12 engages the contact member 23 of the slide gate 18 as shown by dashdotted lines in FIG. 2. The contact plate 31 reaches underneath the contact member 23, whereby the latter, and with it the slide gate 18, may be lifted against the force of the spring 20 as will be presently described.

The protruding cover plate 15 and the guide member 25 make sure that the supply chute 5 and the guide chute 28 are properly aligned or registered with each other. Now, the driver 1 and thus the magazine 11 are slightly raised upwardly until a side wall 27 stops against the stopper cam 26. The lifting of the magazine lifts the slide gate 18 by means of the contact plate 31, whereby the gate plate 22 releases the row of fasteners in the supply chute 5. The fasteners 3 now glide under the effect of gravity into the guide chute 28 until the latter is filled. Upon removal of the driver 1 away from the sorting apparatus 2, the spring 20 moves the slide gate 18 downwardly, whereby the gate plate 22 prevents any sliding of further fasteners 3. The head of the first fastener now rests against the slanted stop surface 21 so that the shaft of the fastener extends substantially vertically, whereby the matching of the magazine 11 with the guide rail 6 is facilitated for the next filling operation.

The operator now moves, with the aid of the bail 29, the slide pusher 12 back into the guide chute 28, whereby the slide pusher 12 under the influence of the spring 13 pushes the fasteners 3 toward the discharge channel 9. Thus, the guide chute 28 is closed at its end behind the fasteners and it is possible to use the driver 1 for driving fasteners in any desired direction.

Although the invention has been described with reference to specific example embodiments, it will be appreciated, that it is intended, to cover all modifications and equivalents within the scope of the appended claims.

What is claimed is:

1. An apparatus for supplying fasteners into a magazine means of a fastener driver, comprising magazine means for supplying fasteners to a fastener driver, slide pusher means slidable in said magazine means for pushing fasteners in said magazine toward said fastener driver, fastener supply chute means including gate means at the discharge end of said supply chute means, said slide pusher means being arranged for actuating said gate means when said magazine means is brought into a cooperating position relative to said fastener supply chute means when the slide pusher means is in a gate opening position.

2. The apparatus of claim 1, wherein said gate means comprise guide means and a slide gate operatively held by said guide means, whereby the slide gate is movable back and forth between an open position and a supply chute closing position.

3. The apparatus of claim 1, wherein said gate means comprise guide means and a slide gate operatively held by said guide means, said guide means simultaneously forming a supply channel in said fastener supply chute means, said slide gate having a slanted surface arranged in alignment with said supply channel, whereby fasteners are held in a substantially vertical position when the slide gate is closed.

4. The apparatus of claim 1, further comprising spring means operatively biasing said gate means into a position closing the discharge end of said supply chute means in such a manner that insertion of said slide pusher means into the free end of said supply chute means opens the gate means and withdrawal of said slide pusher means closes the gate means.

5. The apparatus of claim 1, further comprising spring means in said magazine means operatively connected to said slide pusher means for normally urging said slide pusher means against fasteners in said magazine means, and recess means near the free end of said magazine means for receiving and retaining said slide pusher means when the slide pusher means is in said gate opening position.

* * * * *